US005416506A

United States Patent [19]

Arai et al.

[11] Patent Number: 5,416,506

[45] Date of Patent: May 16, 1995

[54] IMAGE-FORMING APPARATUS

[75] Inventors: Kazuhiko Arai; Kiyoshi Shigehiro; Toru Teshigawara; Kazuo Terao, all of Kanagawa, Japan

[73] Assignee: Fuji Xerox Co., Ltd., Tokyo, Japan

[21] Appl. No.: 22,925

[22] Filed: Feb. 26, 1993

[30] Foreign Application Priority Data

Feb. 28, 1992 [JP] Japan ..... 4-044012

[51] Int. Cl.[6] ..... B41J 2/435

[52] U.S. Cl. ..... 347/135; 347/247

[58] Field of Search ..... 346/1.1, 107 R, 108, 346/76 L, 160

[56] References Cited

FOREIGN PATENT DOCUMENTS 56-91228A 7/0981 Japan .
60-208162A 10/1985 Japan .
1-280965A 11/1989 Japan .
2-63756A 3/1990 Japan .
3-2763A 1/1991 Japan .
3-2773A 1/1991 Japan .
3-4244A 1/1991 Japan .

OTHER PUBLICATIONS

Noise Perception on Electrophotography, Dooley et al., Journal of Applied Photographic Engineering, 5(4):190–196 (1979).

*Primary Examiner*—Mark J. Reinhart
*Attorney, Agent, or Firm*—Finnegan, Henderson, Farabow, Garrett & Dunner

[57] ABSTRACT

An image forming apparatus which comprises a laser light source, a light beam scanning unit which scans an image receiving member with a light beam, and an optical system for forming a spot of the light beam, which has a predetermined diameter. The light beam is modulated by a pulse modulation unit based on the density data of an image. The size of picture elements formed on the image receiving member is a function of parameters of the laser scanning unit and the pulse modulation unit, and the spot size is designed at least 1.7 times as large as the corresponding size of picture elements.

2 Claims, 7 Drawing Sheets

IMAGE-FORMING APPARATUS

BACKGROUND OF THE INVENTION

1. Field of the Invention

The present invention relates to an image-forming apparatus adopting an electrophotographic method, which develops a latent image formed on a photoconductive member by utilizing a laser beam.

2. Discussion of the Related Art

Digital electrophotographic methods have been widely employed as recording methods to provide an image of high quality at high speed. An area modulation method using a dot screen or line screen has been conventionally employed as a method of recording a halftone image for an image-forming apparatus adopting the electrophotographic method such as described above.

The area modulation method has a relatively simple algorithm which can be implemented at low cost. However, the basic construction of the area modulation method represents gradations of gray by repetition of white portions of paper and colored portions with toner or the like; therefore the repetition pattern of the white and colored portions is apt to be seen as image noise by the observer and cannot provide high image quality.

To obtain an image of high quality and of high resolution, an attempt has been made to combine a plurality of laser beams into one beam of extremely small diameter to form a latent image on a photoconductive member therewith, but the problem occurs that the design of the optical system is extremely difficult and the system is necessarily bulky.

On the other hand, as a method for recording a halftone image without employing the area modulation method, the method of modulating the light beam intensity corresponding to the image density required, referred to as the intensity modulation method is also known. According to this method, image noise caused by the repetition of white and colored portions in the process of image formation by the area modulation method does not occur.

In the intensity modulation method, an ultrasonic light modulator may be used or a method of varying the amount of current supplied to a semiconductor laser may be adopted to modulate the intensity of the light beam. However, an ultrasonic light modulator is expensive and intricate, and besides, high precision is required in installation. For this reason, the method of changing the amount of current supplied to a semiconductor laser is ordinarily used.

However, the semiconductor laser has a property that a small change in the input current causes a large change in the radiation output as shown in FIG. 6, and accordingly the problem occurs that a small change in the amount of input current supplied to the semiconductor laser corresponding to density data cannot provide an image which represents halftones adequately.

Many different methods including extremely stable power supply circuits have been proposed to overcome the above-mentioned problem, but it is very difficult to construct a stable power supply circuit, and besides, the circuit is necessarily bulky. Moreover, semiconductor lasers are highly dependent on environmental factors; therefore various compensating circuits, such as a circuit correcting for changes in temperature are required, thus leading to high cost and a bulky apparatus.

Japanese Patent Application Unexamined Publication No. Sho. 60-208162 (1985) proposes an image formation apparatus employing the intensity modulation method where the number of bits in the light intensity control signal is larger than that of the original image signal, so that an original image may-be reproduced with higher fidelity. However, there is an upper limit to the number of bits in the light intensity control signal (normally 8 bits) because of the limit to the data memory capacity per one picture element. To make the number of bits in the light intensity control signal larger than that of the original image signal, reducing of the number of bits in the original image signal to 6 bits for example, is required: therefore number of gradations of gray is reduced, thus resulting in difficulty in reproducing the gray-scale image with high fidelity.

In Japanese Patent Application Unexamined Publication No. Sho. 56-91228 (1981), the input density signal is modulated to generate a pulse signal for controlling a clock pulse signal of high frequency and applying the controlled clock pulse to a semiconductor laser, thus recording an image which includes some tens or more of halftone levels. However, this method is based on the area modulation method, and accordingly no solution is presented to the problem of image noise in the area modulation method caused by the repetitive pattern of paper white portions and colored portions.

There is another problem in adopting the intensity modulation method, in that the graininess of an image formed by this method is inferior to that of an image formed by the area modulation method even though toner of the same particle diameter is used in both cases. That is, the intensity modulation method is inferior to the area modulation method in smoothness of the formed image. The reason is as follows: it is known that the relation between density and graininess is roughly as shown in FIG. 7, wherein the parameter is the toner particle diameter. Every dot in a dot screen or every rectangle in a line screen is formed at a relatively high density which is predetermined, and the other low density portions are the bare surface of the recording medium. In other words, only the density ranges indicated as A and B in the figure are used in the area modulation method, resulting in comparatively good graininess characteristics even when toner of relatively large particle diameter is used.

On the other handy the intensity modulation method employs the whole density range shown in FIG. 7, and therefore the graininess of the image formed by this method is worse than that of an image formed by the area modulation method, particularly in areas of medium density.

SUMMARY OF THE INVENTION

The present invention has been made in view of the above circumstances and has as an object to overcome the problems mentioned above.

A further object of the present invention is to provide an image-forming apparatus which has a similar construction to that adopting the area modulation method but realizes a similar function to that adopting the intensity modulation method.

Another object of the present invention is to provide an image-forming apparatus which forms a halftone image of satisfactory graininess characteristics.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the image-forming apparatus of this invention comprises a laser light source, a light beam scanning means for scanning an image receiving member with a light beam produced by the laser light source, an optical system for forming a spot of the light beam having a predetermined diameter on the image receiving member, and a drive pulse width modulation means for modulating a laser drive pulse width per one picture element corresponding to an image density value of recording information, wherein the diameter of the light beam spot on the image receiving member is predetermined to be at least 1.7 times as large as the pitch of the picture elements.

In the present specification, the diameter of the light beam spot refers to the $1/e^2$ diameter.

An image-forming apparatus according to the present invention is also characterized in that a latent image formed by the light beam on the image receiving member is developed in a wet or dry process with toner having a particle diameter of 5 μm or less.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE PREFERRED EMBODIMENTS

Figure 1:
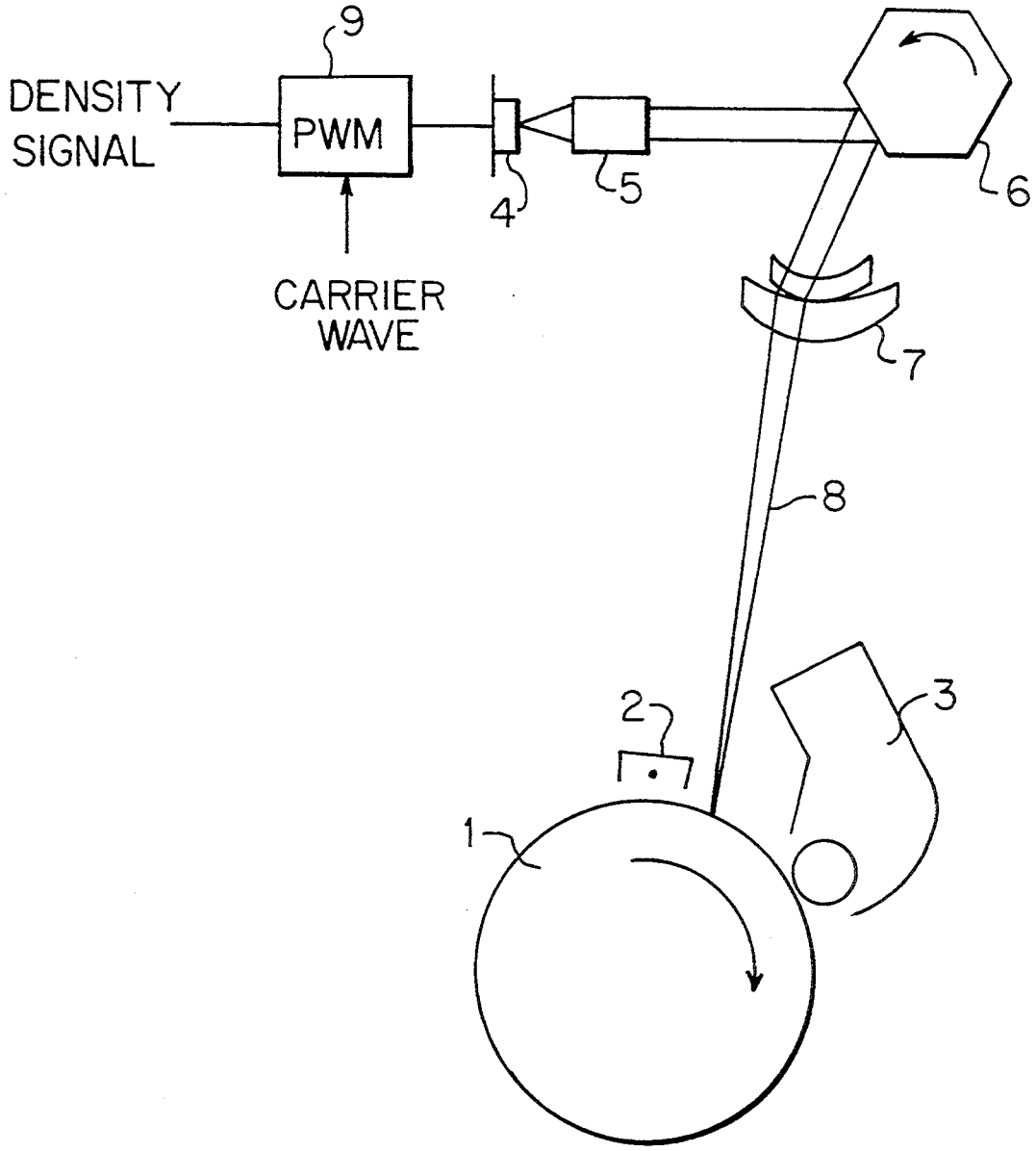
FIG. 1 shows the construction of an image-forming apparatus according to the present invention.
Figure 2A:
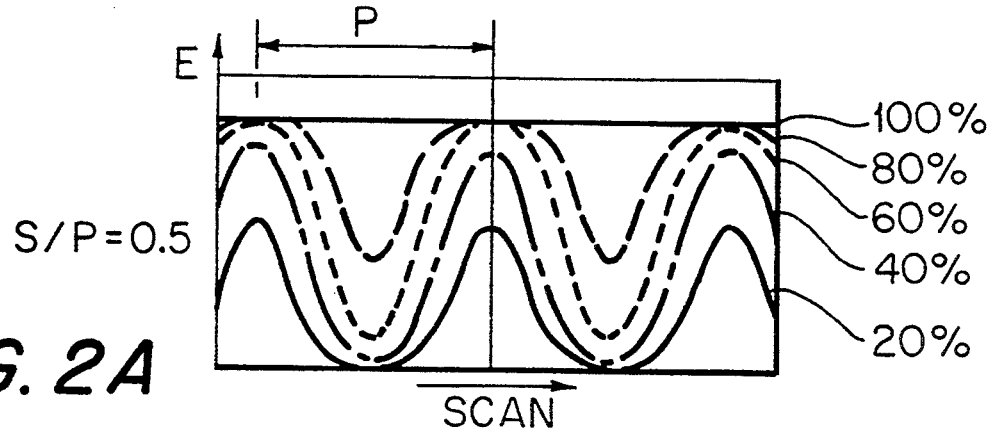
FIG. 2A through 2D are views illustrating the function of an image-forming apparatus according to the present invention.
Figure 2B:
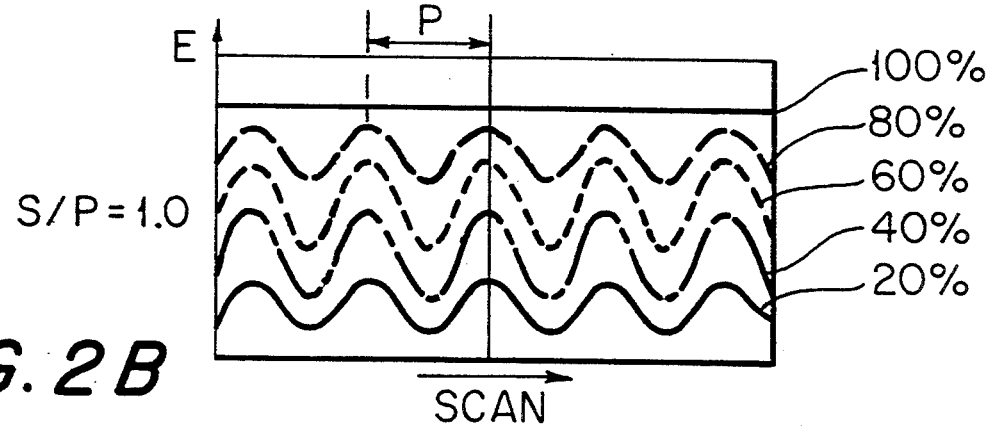
Figure 2C:
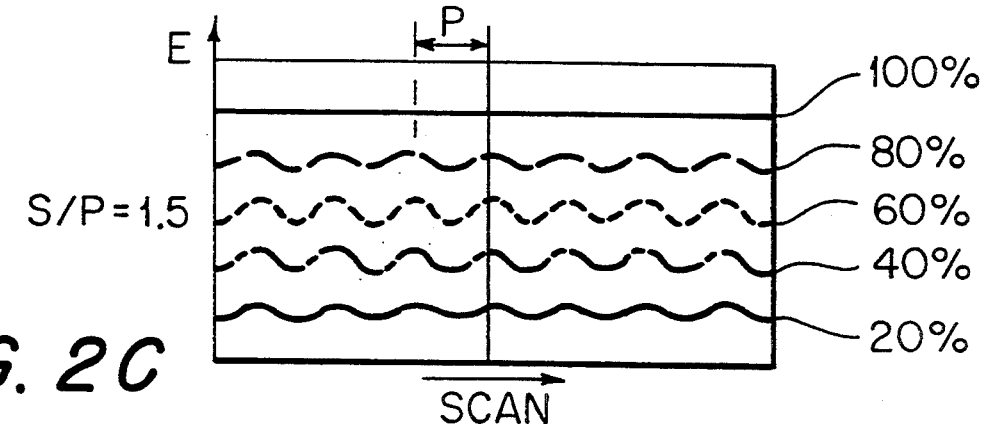
Figure 2D:
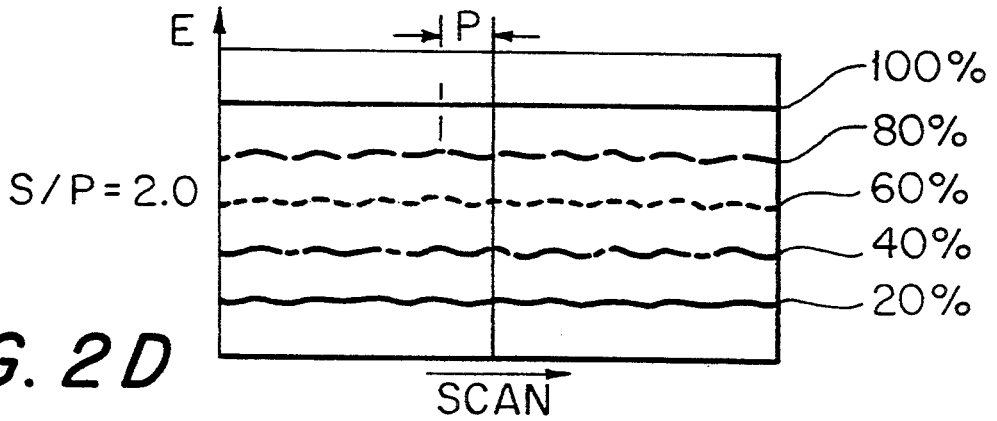

First, the construction of the image-forming apparatus shown in FIG. 1 will be described. In the figure, a charging corotron 2 and a developing device 3 are installed around an image receiving member 1 rotating in the direction indicated by an arrow. Either a photoreceptor itself or a carrying member for photoconductive paper and the like can be used as the image receiving member 1. A raster output scanner comprises a semiconductor laser 4, a collimator lens 5, a polygonal mirror 6 and an f-θlens 7. The image density signal provided by an image reading device (not shown in the figure) is modulated by a pulse width modulation circuit 9. A light beam emitted by the semiconductor laser 4 is controlled to be on and off by an output signal from the pulse width modulation circuit 9 to expose the image receiving member 1.

The pulse width modulation method is normally an image forming method for forming an image on an image receiving member by modulating a laser drive pulse width, where one pulse corresponds to one picture element. For example, the duty factor of the laser beam pulse for one picture element A may be 20%, and for another picture element By the duty factor of the laser beam pulse may be 80%. Thus a difference arises in exposure between picture elements A and B, which causes the difference of density between picture elements A and B, thus reproducing the gradation.

Figure 8:
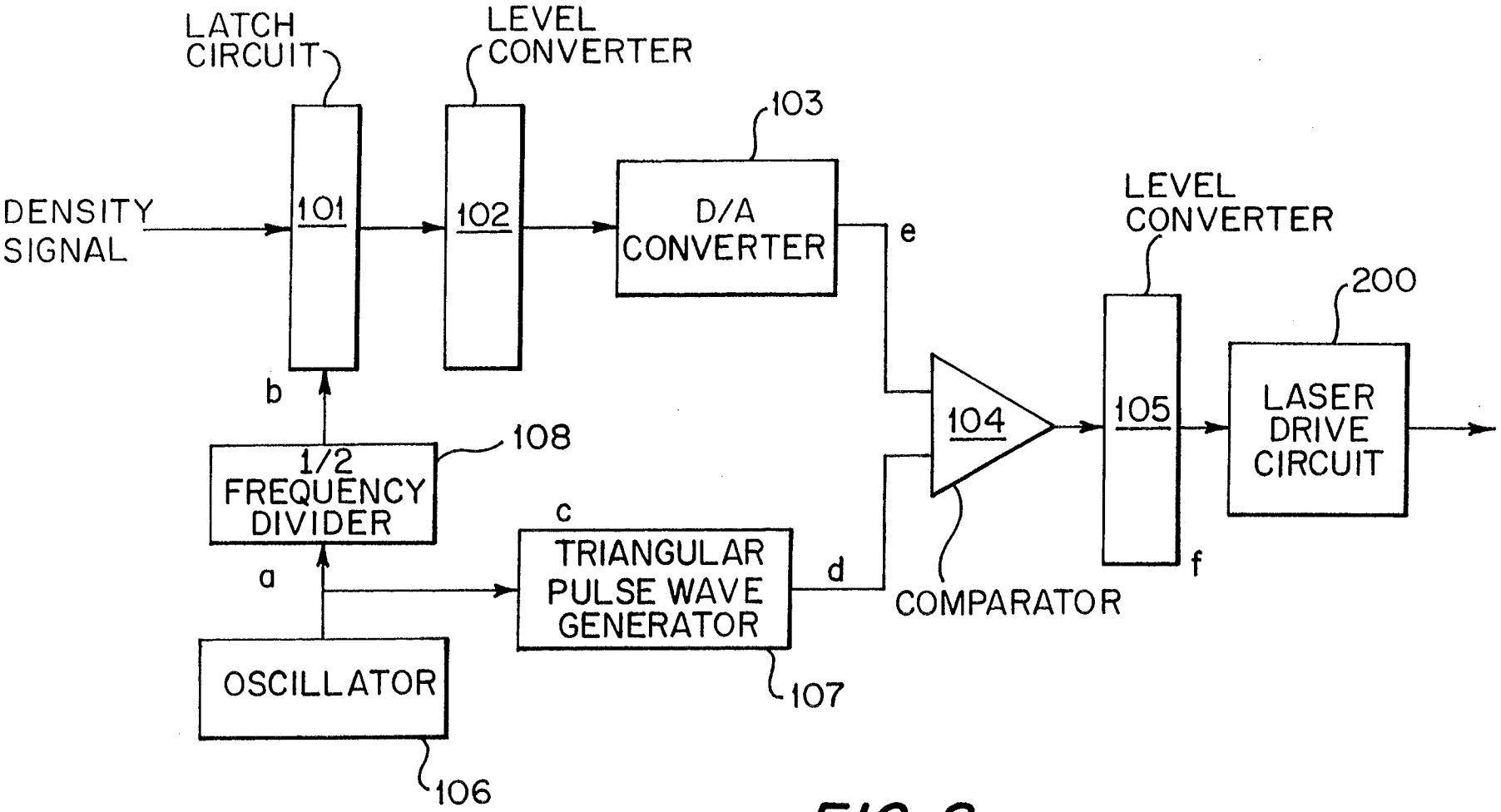
FIG. 8 is a circuit diagram showing a pulse width modulation circuit 9 adapted for an apparatus shown in FIG. 1.
Figure 9:
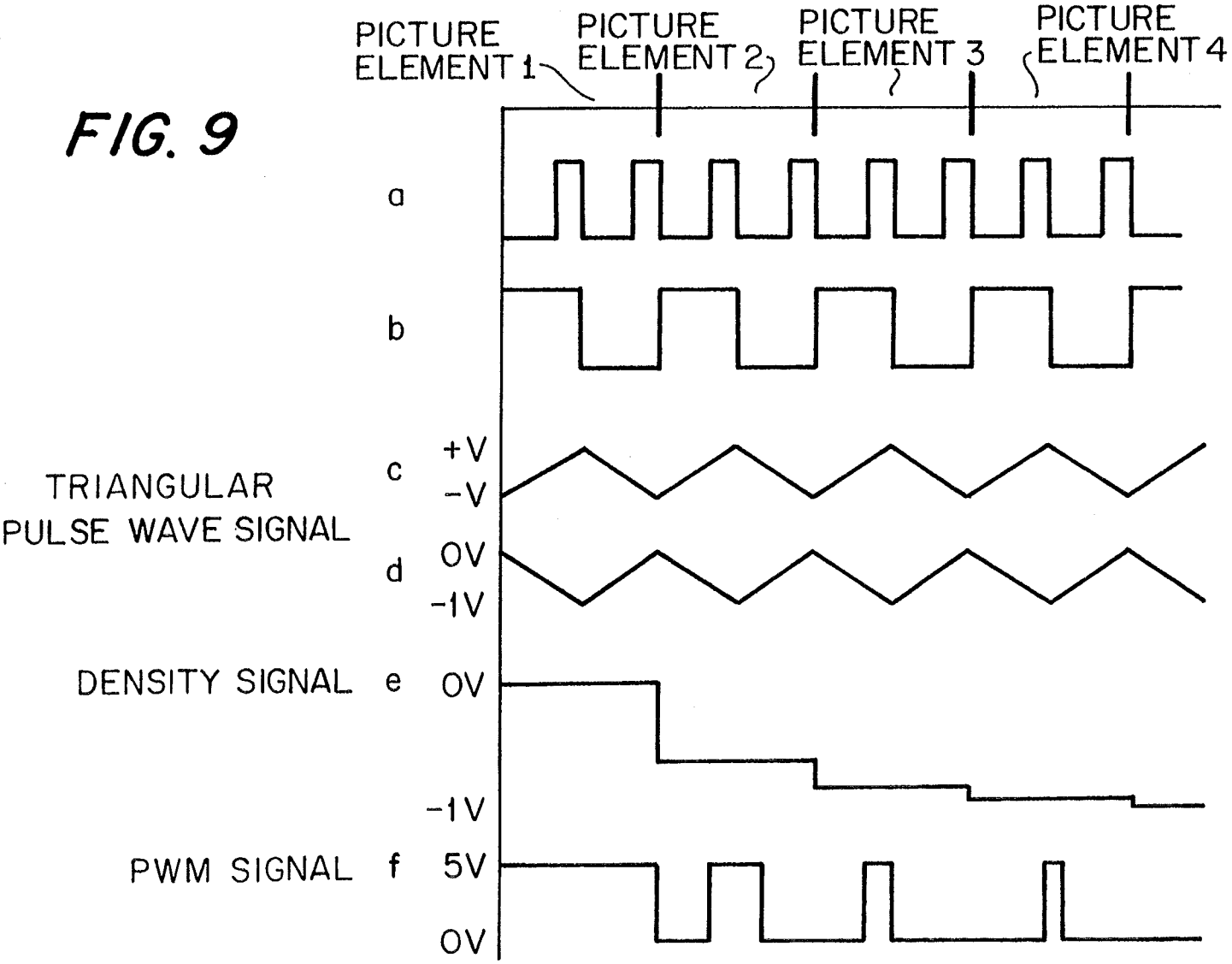
FIG. 9 is a timing chart showing the operation of the pulse width modulation circuit 9 shown in FIG. 8.

FIG. 8 is a circuit diagram showing a pulse width modulation circuit 9 adapted for the apparatus shown in FIG. 1. FIG. 9 is a timing chart which shows the operation of the pulse width modulation circuit 9 shown in FIG. 8. Signals a, b, c, d, e and f in FIG. 8 and signals a, b, c, d, e and f in FIG. 9 correspond to each other.

In FIG. 9, the frequency of a signal a generated by an oscillator 106 is divided by two by a ½ frequency divider 108 to generate a signal b. The signal b is input to a latch circuit 101. A density signal is derived from an image reading device or the like (not shown in the figure) and is input to the latch circuit 101, the level converter 102, the D/A converter 103 and the comparator 104 in that order. The signal a generated by the oscillator 106 is also input to a triangular pulse wave generator 107 to be converted into a triangular pulse wave signal d which has a peak of −1 V, and then input to the comparator 104. A comparative signal output from the comparator 104 is converted into a pulse width modulation signal f corresponding to the density signal by a level converter 105 and input to a laser drive circuit 200 which is connected to a semiconductor laser 4 which it drives. The semiconductor laser 4 produces a laser beam whose pulse width has been modulated corresponding to the pulse width modulation signal f to irradiate the surface of the image receiving member.

FIG. 1 shows the same construction as a conventional image-forming apparatus adopting the area modulation method. FIGS. 2A through 2D show an exposure energy profile on the image receiving member 1, where the spot diameter S of the light beam 8 is fixed and the picture element pitch P in the fast scan direction is changed, thus changing the ratio S/P. Percentage values in FIGS. 2A through 2D are the duty factors of drive signals of the laser beam. The scanning speed of the light beam 8 and the frequency of the carrier wave input to the pulse width modulation circuit 9 determine the picture element pitch P in the fast scan direction, and the transfer width of the light beam 8 in the slow scan direction determines the picture element pitch P in the slow scan direction, as is known to those skilled in the relevant art.

In FIGS. 2A through 2D as the light beam spot diameter S becomes larger against the picture element pitch P, irregularity of the exposure energy profile diminishes. That is to say, the area modulation method in which repetitive background white portions and toner colored portions appear changes into the intensity modulation method varying the exposure intensity. When the light beam spot diameter S is 1.7 times as large as the picture element pitch P or more, a latent image can be formed with the same quality as a latent image formed by the intensity modulation method. The same can be said of the picture element pitch in the the slow scan direction.

Provided that the spot diameter of the light beam is maintained to be at least 1.7 times as large as the picture element pitch, either the spot diameter of the light beam or the picture element pitch, or both can be changed in principle. However, from the viewpoint of resolution, it is preferable that the spot diameter of the light beam is set to be the same size as that of the conventional pulse width modulation method and the picture element pitch is reduced so that the spot diameter of the light beam is at least 1.7 times as large as the picture element pitch.

Using the ratio of the spot diameter to the picture element pitch described above, the variation in exposure in a scan caused by switching the laser beam on and off becomes small. That is, the average amount of the light on the scanned surface tends to change smoothly. In the case of reproduction of a halftone image, because the surface potential of the image receiving member is changed smoothly corresponding to the drive pulse width of the laser beam controlled by the pulse width modulation method, the same effect can be obtained as if the intensity of the laser beam were modulated. In other words, a simple pulse width modulation method can provide the same effect as obtained by the intensity modulation method. There are some cases that the density of obtained output image does not change linearly corresponding to the drive pulse width of the laser beam when the potential-density characteristics of the developing device employed are unsatisfactory. However, by selecting a developing device with adequate potential-density characteristics, the image density is well reproduced, and in particular, better image density reproduction can be provided by use of toner having a particle diameter of 5 μm or less in development.

Figure 7:
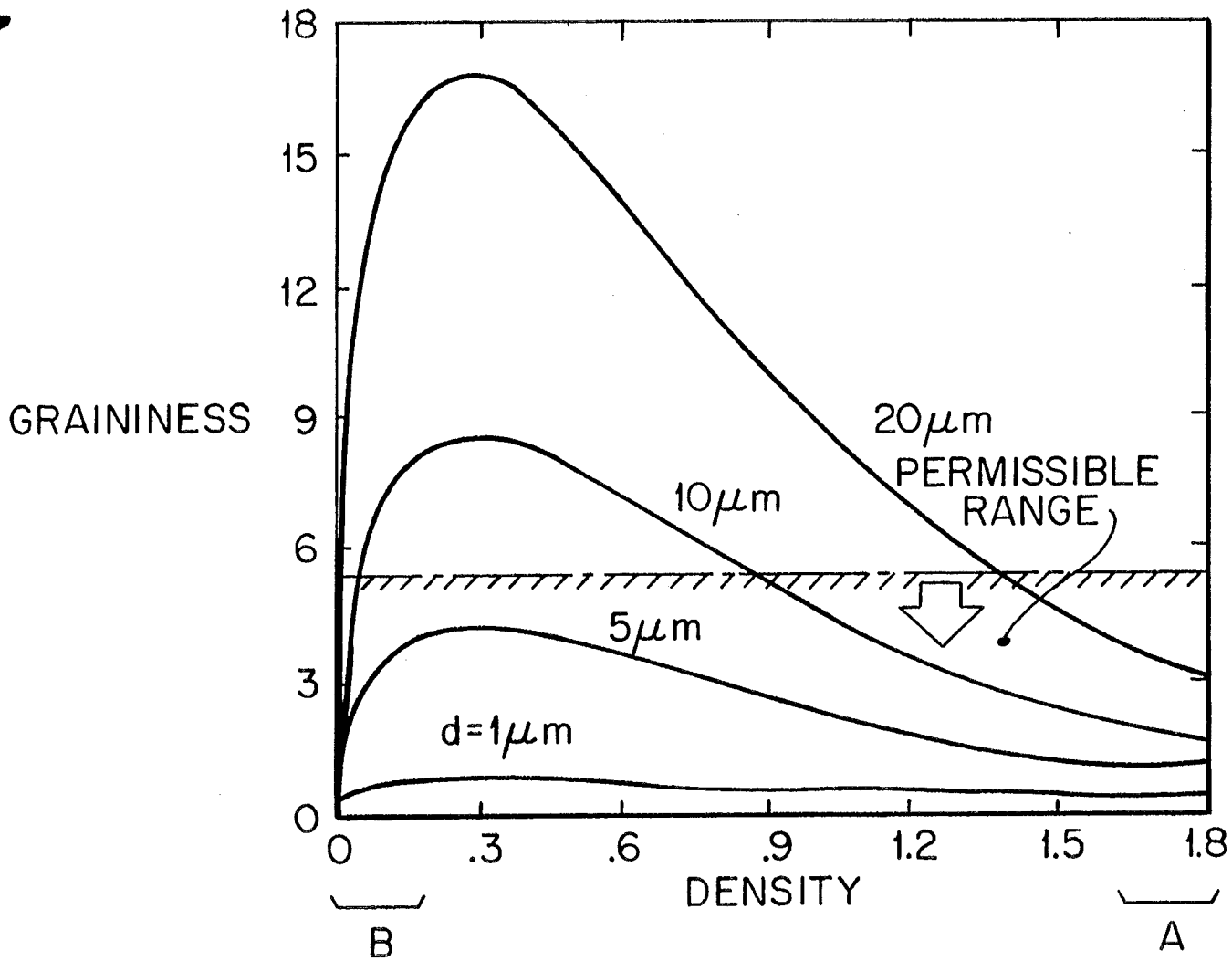
FIG. 7 is a view illustrating a problem of a conventional intensity modulation method.

Specifically, if the permissible range for the graininess of the image is set to be the grade 6 or less, toner with the particle diameter of 5 or less is adequate as will be seen from FIG. 7. Either a wet or a dry process may be adopted for the developing method.

According to the above-mentioned image forming apparatus, the image noise of the area modulation method does not occur and a halftone image with satisfactory graininess characteristics can be obtained.

Now preferred embodiments of an image-forming apparatus according to the present invention will be described in detail based on the drawings.

First Embodiment

Figure 3:
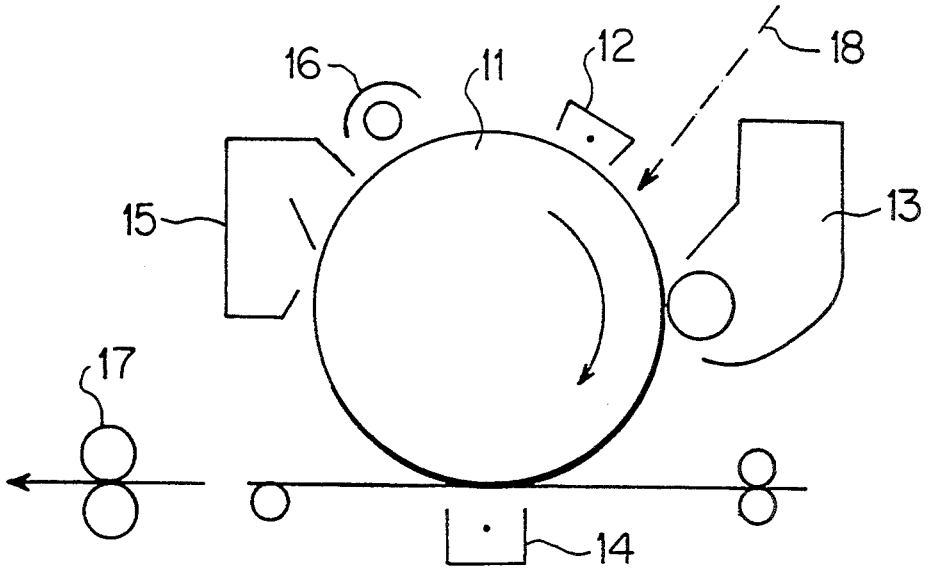
FIG. 3 shows a first embodiment of an image-forming apparatus according to the present invention.

FIG. 3 shows the construction of a first embodiment of an image-forming apparatus according to the present invention. A photoconductive member 11 rotates in the direction shown by an arrow, and a charging corotron 12, a developing device 13, a transfer corotron 14, a cleaner 15 and an erase lamp 16 are installed around the photoconductive member 11 in the direction of rotation. The photoconductive member 11 is exposed by a light beam 18 produced by a raster output scanner (not shown in FIG. 3 ) which has the same construction as shown in FIG. 1.

The spot diameter of the light beam 18 on the photoconductive member 11 is set to be at least 1.7 times as large as the picture element pitch. For example, when the resolution in both fast and slow scan directions is 400 dpi, the spot diameter of the light beam 18 on the photoconductive member 11 is set to be 96 μm or more in both fast and slow scan directions. The particle diameter of toner used in the developing device 13 is 5 μm or less.

According to this embodiment, a latent image can be formed on the photoconductive member 11, which has the same image quality as a latent image formed by the intensity modulation method. The latent image on the photoconductive member 11 is developed by the developing device 13 using toner whose particle diameter is 5 μm or less, and then transferred to paper by the transfer corotron 14.

According to the first embodiment of an image-forming apparatus described above, the image noise of the area modulation method does not occur and a halftone image with satisfactory graininess characteristics can be obtained.

Second Embodiment

Figure 4:
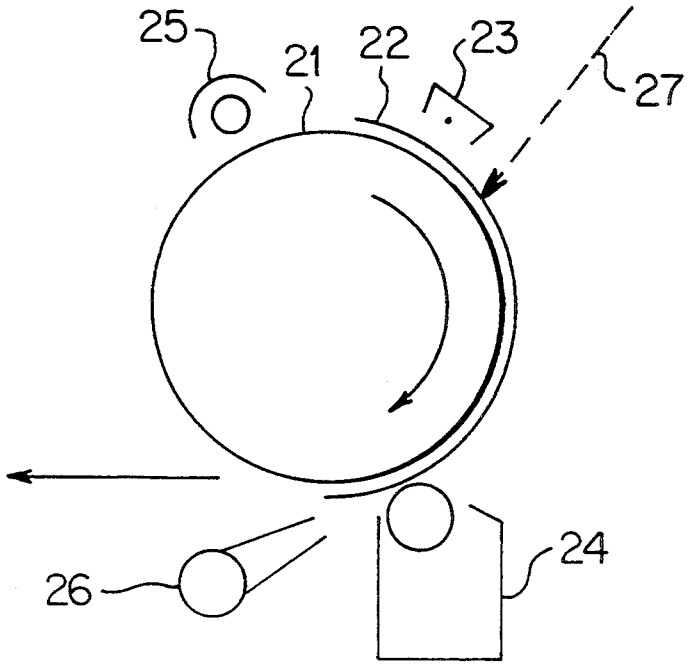
FIG. 4 shows a second embodiment of an image-forming apparatus according to the present invention.

FIG. 4 shows the construction of a second embodiment of the image-forming apparatus according to the present invention. A photoconductive medium 22, such as photoconductive paper, is mounted on a image receiving member 21 rotating in the direction indicated by an arrow in the figure. A carrying belt may equally serve as the image receiving member in place of the rigid rotating member. A charging corotron 23, a developing device 24, a dry fuser 26 and an erasing lamp 25 are installed around the image receiving member 21. The photoconductive paper medium 22 is exposed to a light beam 27 produced by a raster output scanner (not shown in the figure ) having the same construction as shown in FIG. 1.

The spot diameter of the light beam 27 on the photoconductive paper 22 is set to be at least 1.7 times as large as the picture element pitch. For example, when the resolution in the fast scan direction and the resolution in the slow scan direction are both 400 dpi, the spot diameter of the light beam 27 on the photoconductive paper 22 is set to be 96 μm or more both in the fast scan direction and in the slow scan direction. The particle diameter of toner used in the developing device 24 is 5 μm or less.

According to this embodiment, a latent image which has the same image quality as formed by the intensity modulation method can be formed on the photoconductive paper 22. The latent image on the photoconductive paper 22 is developed by the developing device 24 with toner having a particle diameter of 5 μm or less, and then fused by the dry fuser 26 and ejected.

Consequently image noise does not occur, which is an improvement over the area modulation method, and a halftone image with satisfactory graininess characteristics can be obtained.

Third Embodiment

Figure 5:
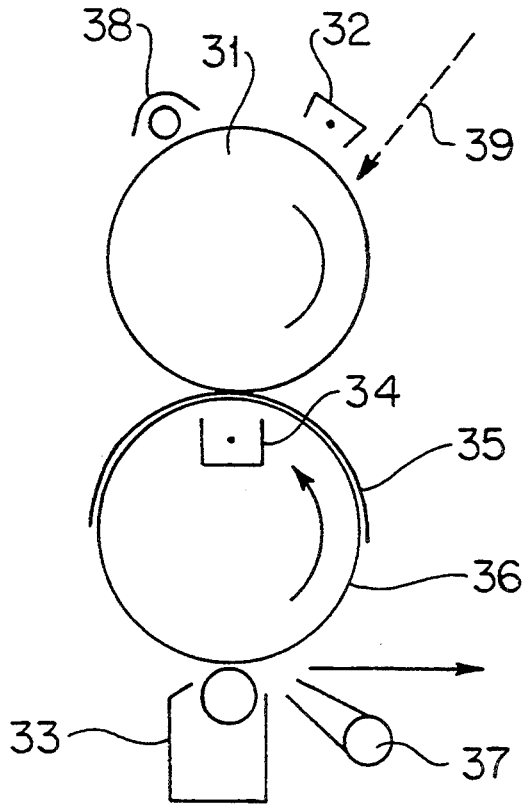
FIG. 5 shows a third embodiment of an image-forming apparatus according to the present invention.
Figure 6:
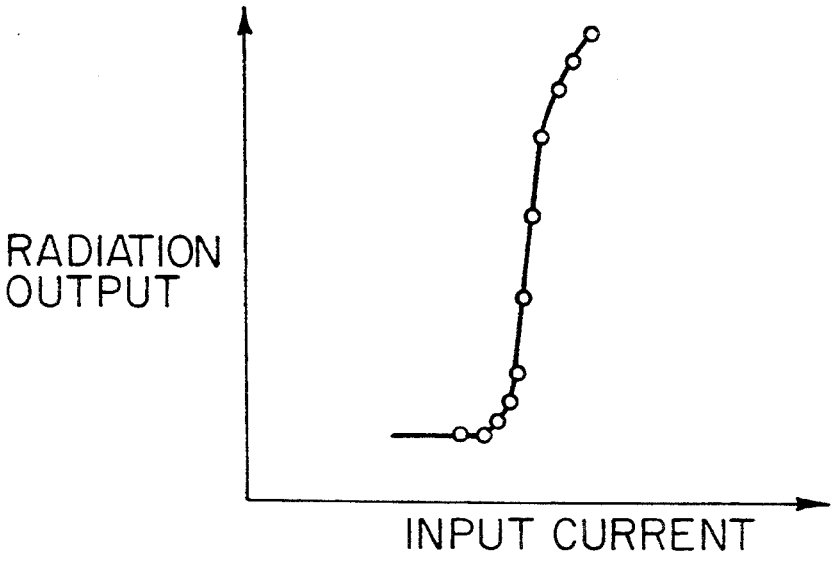
FIG. 6 illustrates a property of a semiconductor laser.

FIG. 5 shows the construction of a third embodiment of the image-forming apparatus according to the present invention. A charging corotron 32 and an erase lamp 38 are installed around a photoreceptor 31 rotating in the direction indicated by an arrow. The photoreceptor 31 is exposed to a light beam 39 produced by a raster output scanner (not shown in the figure) which has the same construction as shown in FIG. 1.

The spot diameter of the light beam 39 on the photoreceptor 31 is set to be at least 1.7 times as large as the picture element pitch. For example, when the resolution in the fast scan direction and the resolution in the slow scan direction are both 400 dpi, the spot diameter of the light beam 39 on the photoreceptor 31 is set to be at least 96 μm both in the fast scan direction and in the slow scan direction. The particle diameter of toner used in the developing device 33 is 5 μm or less.

A latent image formed on the photoreceptor 31 is transferred by a transfer corotron 34 to paper 35 supported by a paper carrying member 36. The latent image transferred to the paper 35 is developed by a developing device 33 with toner having a particle diameter of 5 μm or less, fused by a dry fuser 37, and then ejected from the apparatus.

According to this embodiment, a latent image which has the same image quality as formed by the intensity modulation method can be formed on the paper 35.

Consequently image noise does not occur, which is an improvement over the area modulation method, and a halftone image with satisfactory graininess characteristics can be obtained.

The present invention is not limited to the above-described embodiments, but can be subject to many variations. For example, though the embodiments of the image-forming apparatus are described above in relation to monochrome copying, as a matter of course, the present invention can be adapted to a color image-forming apparatus such as a color copying machine or a color printer.

It is clear by the above-description that the latent image which has the same image quality as formed by the intensity modulation method can be formed on the image receiving member; therefore image noise, such as appears when the area modulation method is employed does not occur. Further, a halftone image with satisfactory graininess characteristics can be obtained because the particle diameter of toner used for development is 5 μm or less, and additionally, the laser optical system can be simplified for the reason that it is unnecessary to narrow the spot diameter of the light beam.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An apparatus for forming an image, comprising:

a laser light source;

a light beam scanning means for scanning an image receiving member with a light beam produced by said laser light source;

an optical system for forming a spot of said light beam having a predetermined diameter on said image receiving member; and a drive pulse width modulation means, connected to the laser light source, for energizing the laser light source by periodic pulses, a cycle time of which corresponds to a size of a picture element, and modulating a pulse width of each of the pulses in accordance with an externally supplied image density value;

wherein the diameter of said light beam spot on said image receiving member is predetermined to be at least 1.7 times as large as a corresponding size of said picture element.

2. An image-forming apparatus according to claim 1, further comprising means for developing a latent image formed by said light beam on said image receiving member with a toner having a particle diameter of no more than 5 μm.

* * * * *